United States Patent [19]

Gerkema et al.

[11] Patent Number: 4,490,264

[45] Date of Patent: Dec. 25, 1984

[54] DEVICE INCORPORATING A BEARING

[75] Inventors: Jan Gerkema; Andries R. Miedema, both of Eindhoven, Netherlands

[73] Assignee: U.S. Philips Corporation, New York, N.Y.

[21] Appl. No.: 365,710

[22] Filed: Apr. 5, 1982

[30] Foreign Application Priority Data

Apr. 21, 1981 [NL] Netherlands ..... 8101931

[51] Int. Cl.[3] ..... C10M 7/02

[52] U.S. Cl. ..... 252/12; 428/673

[58] Field of Search ..... 252/12; 428/642, 644, 428/673; 420/505, 555, 573

[56] References Cited

U.S. PATENT DOCUMENTS

| | | | |
|---|---|---|---|
| 1,912,712 | 6/1933 | Kormann | 420/573 |
| 2,042,625 | 6/1936 | Peterman | 420/573 |
| 3,743,502 | 7/1973 | Hey | 420/573 |
| 3,981,724 | 9/1976 | Prasad | 420/505 |
| 4,210,371 | 7/1980 | Gerkema et al. | 308/DIG. 8 |
| 4,308,248 | 12/1981 | Anderson | 420/555 |
| 4,314,848 | 2/1982 | Todoroki et al. | 428/673 |

*Primary Examiner*—Jacqueline V. Howard

*Attorney, Agent, or Firm*—Norman N. Spain

[57] ABSTRACT

Bearings can be lubricated with ductile metal films. It has been found that the service life of such lubricating films can be improved by the use of metals which are alloyed with a component having a higher surface tension than the metal.

2 Claims, 5 Drawing Figures

DEVICE INCORPORATING A BEARING

Figure 1:
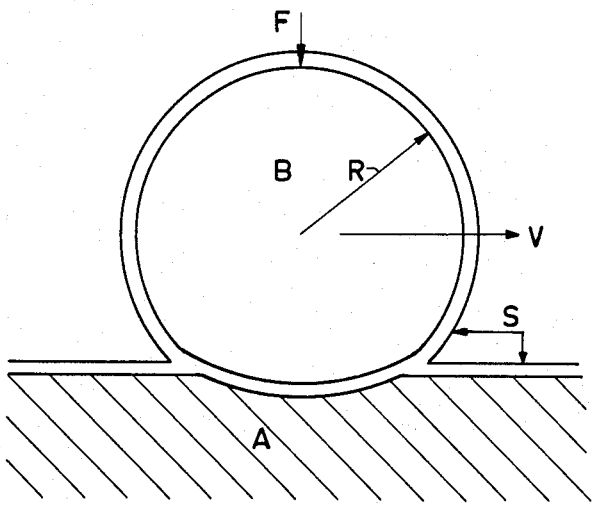

The invention relates to a device incorporating a bearing which is lubricated with a ductile metal alloy.

The invention relates to an arrangement incorporating a bearing, for example an X-ray tube having a rotary anode which is supported in a bearing.

A device incorporating a bearing which is lubricated with a ductile metal alloy is disclosed in United Kingdom Patent Specification No. 684,556. According to this prior art an alloy of silver with one of the metals lead, indium and germanium or an alloy of copper with one of the metals silver, lead and aluminium is used as the metal alloy. It has been found that the lubricating properties of said alloys decrease considerably after prolonged usage (after approximately 100 hours), which results in the friction in the bearing increasing considerably.

The invention has for its object to provide bearings with metal alloys which maintain their excellent lubricating properties, even after prolonged use, and thus ensure a low friction in the bearing for a long period of time.

The invention is based on the recognition of the fact that the use of metal alloys in which interface segregation of the alloy element occurs may furnish a prolonged lubricating action.

The device according to the invention is characterized in that the metal alloy consists of a metallic matrix which is alloyed with 0.1–5 at.% of at least one alloy metal which has a higher surface tension than the metal(s) of the matrix.

For the sake of completeness it should be noted that surface tension is understood to mean the surface tension of the solid material at zero degrees Kelvin. A Table containing the surface tension of a large number of metals is included in an article "The atom as a metalurgical building block" by A. R. Miedema, Philips Technical Review, 38, 257∝268 (1978/1979), at page 262. This article and also the U.S. Pat. No. 4,210,371, mentioned hereinafter, are incorporated in this description by reference.

The above-mentioned alloys intended for use as lubricants are suitable for all types of bearings, such as plain bearings, roller bearings and such like. When choosing the metal alloy, lead must be taken that the selected material does not attack the material of the bearings to be lubricated. When lubricating bearings which operate under a reduced pressure, as is the case with bearings in X-ray tubes, a metal alloy must be chosen which has a vapour pressure corresponding to or lower than the vapour pressure of lead.

For the lubrication of the bearings of rotary anodes in X-ray tubes, the following metal alloys for example satisfy the above-mentioned requirements.

(1) lead alloyed with 0.1–4 at.% of copper.

(2) silver alloyed with 0.1–2 at.% of platinum or molybdenum.

(3) a gallium alloy which is liquid at room temperature and is described in U.S. Pat. No. 4,210,371 to which furthermore 0.1–7 at.% of platinum or rhodium is added as alloy component.

Figure 2A:
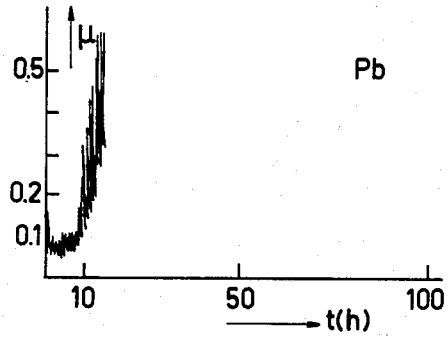
Figure 2B:
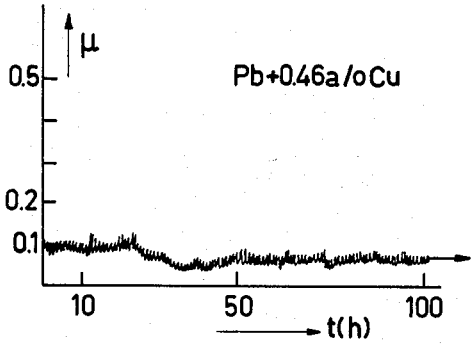
Figure 3A:
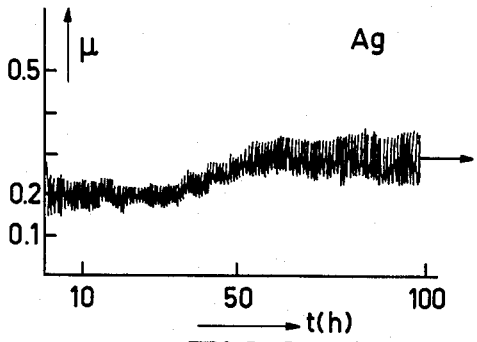
Figure 3B:
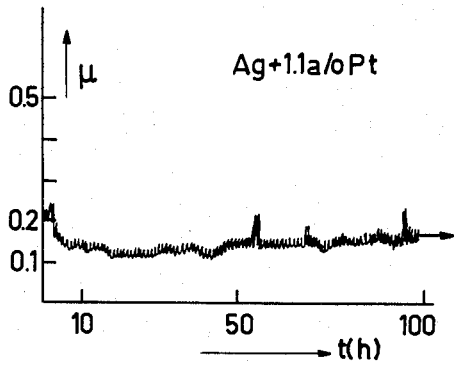

The invention will now be further described by way of example with reference to the accompanyiing drawing, in which:

FIG. 1 shows schematically in a cross-sectional view how the friction of a ball lubricated with a metal (alloy) is determined, FIG. 2 shows how the coefficient of friction ($\mu$) changes versus time (in hours) when pure lead is used (FIG. 2*a*) and when lead alloyed with 0.46 at.% of copper is used (FIG. 2*b*) and FIG. 3 corresponds to FIG. 2, pure silver (FIG. 3*a*) and a silver-1.1 at.% platinum alloy (FIG. 3*b*) being used.

The use of a metallic matrix to which an alloy component having a higher surface tension is added results in a considerable increase of the period of time during which the metallic matrix maintains its lubricating action. From experiments it has been found that this prolongation occurs at temperatures between room temperature and 450° C. This prolongation is assumed to be associated with a segregation of the alloy component with the higher surface tension at the interface of the metallic matrix and the face of the bearing. This assumption is in agreement with the empirical finding that with a comparatively thick lubricating layer, a lower alloy metal content is needed to obtain the same prolongation of the duration of the lubricating action than with a comparatively thin layer.

0.1–5 at.% of the alloy component with the higher surface tension is incorporated in the metallic matrix, for thinner layers a higher alloy content is used, and a lower alloy content is used for thicker layers.

When the content of the alloy component exceeds 5 at.% an unwanted solidification occurs as a result of which the coefficient of friction of the matrix becomes too high. In addition, when the content of the alloy component exceeds 5 at.%, no further prolongation of the period of time defined above occurs.

With the layer thicknesses from 100–200 nm, used in practice, 0.1 at.% of the alloy component forms a boundary value below which the desired prolongation of the time period does not occur or occurs only to an insufficient extent.

The metallic matrix inclusive of the alloy component may be provided in different ways on the bearing surfaces to be lubricated; by means of sputtering, electrochemical processes, "chemical vapour deposition" and such like.

In the following examples the coefficient of friction is always determined by means of the method which is commonly referred to as the "pin on disc" method. Said method is illustrated in FIG. 1. A metallic lubricating film S is applied in a layer thickness of approximately 200 nm on a steel ball B having a radius $R=2.5\times10^{-3}$ meter. This ball B is caused to slide with a velocity $V=2$ cm/sec., a load of a force $F=5N$ being applied over a steel substrate A which is coated with a similar metallic lubricating film S as the ball B. From other experiments, not described here, it has been found that the described effects occur also at different loads and velocities. All experiments were performed in vacuo (less than $10^{-8}$ k Pa) at 25° C. During this test the change in the coefficient of friction versus time is recorded (see FIG. 2 and FIG. 3). The notion "service life" is defined as being that period of time in which, in the above-described circumstances, the coefficient of friction has increased by 50% of the original value. In some cases, particularly for silver-palladium alloys and silver-platinum alloys, a different definition of the service life has been used: by the addition of, for example, palladium to silver, the coefficient of friction is reduced relative to that of pure silver. In the course of time the coefficient of friction increases again in the above-described pin-on-disc method. For this type of alloy the following definition of the service life has been chosen: the period of time within which the coefficient of friction increases to the initial value of the unalloyed metallic matrix.

EXAMPLE I

A layer of pure metal consisting of lead (surface tension $\gamma S = 0.61\ J/m^2$) and silver ($\gamma S = 1.25\ J/m^2$), respectively was deposited by sputtering or by electrochemical deposition onto two of the above-described steel balls. A layer of lead alloyed with copper (0.46 at.% copper $\gamma S = 1.85\ J/m^2$) was deposited on a third ball. A layer of silver alloyed with platinum (1.1 at.% platinum; $\gamma S = 2.55\ J/m^2$) was deposited on a fourth ball. Similar layers were deposited onto four different substrates. The coefficient of friction was determined as a function of time (in hours) under the circumstances mentioned in the foregoing. The results obtained are plotted in the respective FIGS. *2a, 2b, 3a* and *3b*. These Figures show that the addition of a small quantity of alloy component with a higher surface tension results in a lubricating action of a prolonged duration.

EXAMPLE II

Metallic layers on the basis of a lead matrix having a composition as shown in Table A were deposited on a ball and on a substrate as described above. Table A shows in $J/m^2$ the surface tension ($\gamma s$) of the matrix metal and of the alloy component. The service life of the alloys is markedly improved compared with the pure metal matrix. The alloy with 27 at.% of copper falls outside the invention. This alloy indeed has an advantageous service life but the coefficient of friction ($\mu$) is too high.

TABLE A

| Metal alloy | $\gamma S$ of the alloy component ($J/m^2$) | $\mu$ | service life (hours) |
|---|---|---|---|
| Pure lead $\gamma s = 0.61\ J/m^2$ | | 0.07 | 3 |
| lead + 0.46 at. % copper | 1.85 | 0.07 | more than 100 |
| lead + 1.1 at. % platinum | 2.55 | 0.07 | more than 135 |
| lead + 0.63 at % molybdenum | 2.95 | 0.09 | more than 65 |
| lead + 4.0 at. % copper | 1.85 | 0.07 | more than 145 |
| lead + 27 at. % copper | 1.85 | 0.19 | 150; 65 |

EXAMPLE III

Layers on the basis of silver having a composition as shown in Table B were deposited in the manner described above. Table B shows the results obtained therewith.

TABLE B

| Metal alloy | $\gamma S$ of the alloy component ($J/m^2$) | $\mu$ | service life (hours) |
|---|---|---|---|
| silver ($\gamma s = 1.25\ J/m^2$) | | 0.25 | 30 |
| silver + 1.71 at % copper | 1.85 | 0.20 | 17; 26 |
| silver + 1.1 at % platinum | 2.55 | 0.14 | more than 139 |
| silver + 0.6 at % molybdenum | 2.95 | 0.22 | more than 100 |
| silver + 1.8 at % palladium | 2.10 | 0.22 | 8 |
| silver + 1.4 at % palladium | 2.10 | 0.17 | 52 |
| silver + 1.2 at % palladium | 2.10 | not determined | 16 |

What is claimed is:

1. A bearing coated with a lubricating layer consisting of an alloy of silver and 0.1–2 at.% of a metal selected from the group consisting of molybdenum and platinum.

2. A bearing coated with a lubricating layer consisting of a gallium alloy, liquid at room temperature, alloyed with 0.1–5 at.% of a metal selected from the group consisting of platinum and rhodium.

* * * * *